US010135104B2

(12) United States Patent
Bolander et al.

(10) Patent No.: US 10,135,104 B2
(45) Date of Patent: Nov. 20, 2018

(54) WAVEGUIDE GASKET

(71) Applicant: Telefonaktiebolaget L M Ericsson (publ), Stockholm (SE)

(72) Inventors: Lars Bolander, Mölndal (SE); Ove Persson, Hunnebostrand (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 298 days.

(21) Appl. No.: 14/901,490

(22) PCT Filed: Dec. 15, 2015

(86) PCT No.: PCT/EP2015/079775

§ 371 (c)(1),
(2) Date: Dec. 28, 2015

(87) PCT Pub. No.: WO2017/101980

PCT Pub. Date: Jun. 22, 2017

(65) Prior Publication Data

US 2018/0034124 A1 Feb. 1, 2018

(51) Int. Cl.

| | |
|---|---|
| ***H01P 1/04*** | (2006.01) |
| ***H01P 11/00*** | (2006.01) |
| ***H01P 5/02*** | (2006.01) |

(52) U.S. Cl.
CPC ..... *H01P 1/042* (2013.01); *H01P 5/024* (2013.01); *H01P 11/002* (2013.01)

(58) Field of Classification Search
CPC ..... H01P 1/042; H01P 5/024; H01P 11/002
USPC ..... 333/254
See application file for complete search history.

(56) References Cited

U.S. PATENT DOCUMENTS

| | | | | |
|---|---|---|---|---|
| 2,469,474 | A | 5/1949 | Perry | |
| 2,783,295 | A | 2/1957 | Ewing et al. | |
| 2,885,459 | A | 5/1959 | Pulsifer et al. | |
| 4,932,673 | A | 6/1990 | Domnikov et al. | |
| 5,105,056 | A * | 4/1992 | Hoge, Jr. | H05K 9/0016 174/356 |

(Continued)

FOREIGN PATENT DOCUMENTS

WO 2012076994 A1 6/2012

*Primary Examiner* — Benny Lee
*Assistant Examiner* — Hafizur Rahman
(74) *Attorney, Agent, or Firm* — Murphy, Bilak & Homiller, PLLC

(57) ABSTRACT

The present disclosure relates to a waveguide gasket (1) arranged for electrically sealing a waveguide interface (2) between a first contact end (7) and second contact end (8) of the waveguide gasket. The waveguide gasket (1) comprises a plurality of electrically conducting members (3) that are positioned along a circumference (4) along which the waveguide gasket (1) extends. Each electrically conducting member (3) has a first end (5) and a second end (6) compressibly separable by a variable first height ($h_1$) along a first direction ($d_1$). Each first end (5) faces the first contact end (7) and each second end (6) faces the second side contact end (8), where each first contact end (7) and each second contact end (8) are separated by a variable second height ($h_2$) along the first direction ($d_1$), At least one electrically conducting member (3) is arranged to expand only along said circumference (4) when compressed.

10 Claims, 7 Drawing Sheets

(56) References Cited

U.S. PATENT DOCUMENTS

| | | | | |
|---|---|---|---|---|
| 5,682,299 | A | 10/1997 | Kunert | |
| 2017/0062895 | A1* | 3/2017 | Zhu | H01P 3/12 |

* cited by examiner

WAVEGUIDE GASKET

TECHNICAL FIELD

The present disclosure relates to wireless communication systems, and in particular to a waveguide gasket arranged for electrically sealing a waveguide interface.

BACKGROUND

In many fields of wireless communication, such as microwave communication, waveguides are used for transporting wireless signals, due to the low losses incurred in a waveguide. When mounting or connecting one waveguide section to another section, there is often a gap between the endpoints of the sections.

When there is a gap between two waveguide sections in a waveguide arrangement, it has to be bridged to avoid leakage, return loss and transition loss for the electromagnetic field contained within the waveguide arrangement. An opening that allows the electromagnetic field to partly escape the waveguide arrangement affects return loss and transition loss, i.e. both unwanted reflections and losses occur. Today, a resilient ring gasket that comprises conductive material is commonly used. For example, U.S. Pat. No. 4,932,673 describes a gasket that comprises an electrically conductive elastomeric ring filled with metallic particles.

Such solutions work acceptable for frequencies up to about 38 GHz. For higher frequencies, the waveguide dimensions become relatively small and a resilient gasket tends to expand into the waveguide when compressed, changing the waveguide measures, which affects the transmission properties in an undesired manner.

There is thus a need for an improved waveguide gasket that does not affect the transmission properties when compressed.

SUMMARY

It is an object of the present disclosure to provide an improved waveguide gasket that does not affect the transmission properties when compressed.

Said object is obtained by means of a waveguide gasket arranged for electrically sealing a waveguide interface between a first contact end and second contact end of the waveguide gasket. The waveguide gasket comprises a plurality of electrically conducting members that are positioned along a circumference along which the waveguide gasket extends. Each electrically conducting member has a first end and a second end compressibly separable by a variable first height along a first direction, where the variable first height is equal to, or falls below, a maximum first height. Each first end faces the first contact end and each second end faces the second side contact end, where each first contact end and each second contact end are separated by a variable second height along the first direction. At least one electrically conducting member is arranged to expand only along said circumference when compressed, such that an expansion of the waveguide gasket in a direction towards a gasket opening that is defined and surrounded by the electrically conducting members is avoided.

A number of advantages are obtained by means of the present disclosure. Mainly, a waveguide gasket that does not affect the transmission properties when compressed is provided.

According to an example, at least one electrically conducting member is arranged to expand during compression only towards at least one other adjacent electrically conducting member.

According to another example, at least one electrically conducting member is formed such that a partial overlap with at least one other adjacent electrically conducting member is enabled during compression.

This confers an advantage of that the electrically conducting members may be formed such that a virtual electrical wall is enabled for a relatively large maximum first height, enabling that electrical insulation is maintained while the waveguide gasket at the same time is able to handle relatively large gaps and angular misalignment between waveguide sections when assembling.

According to another example, the first height is equal to the second height.

According to another example, the electrically conducting members are connected to each other, forming a waveguide gasket in the form of a helix spring.

According to another example, the electrically conducting members are formed by discrete elements that each comprise at least one inclination section, each inclination section being arranged to move towards at least one other adjacent electrically conducting member when the first height decreases.

This confers an advantage of that the electrically conducting members may be formed independently.

According to another example, the electrically conducting members are attached to a first frame part and a second frame part, where the first frame part comprises the first side contact end and the second frame part comprises the second side contact end.

This confers an advantage of that the waveguide gasket may be manufactured in a cost-effective manner, for example by means of etching or laser-cutting of a metal sheet.

According to another example, the maximum first height exceeds a first distance defining a length of a space between adjacent electrically conducting members along a second direction perpendicular to the first direction when the variable first height equals the maximum first height.

This adds to the advantage of enabling that electrical insulation is maintained while the waveguide gasket at the same time is able to handle relatively large gaps and angular misalignment between waveguide sections when assembling, since the first distance may be kept sufficiently small for forming a virtual electrical wall, maintaining an electrical insulation, while the waveguide gasket at the same time is able to adapt to relatively large distance differences between the waveguide sections at the interface since the maximum first height may be kept relatively large. The maximum first height may be determined more or less independently of the first distance.

According to an example, such a waveguide gasket may be manufactured by means of a first method for manufacturing a waveguide gasket, where the method comprises using a 3D-printer for printing a plurality of electrically conducting members that are positioned along a circumference along which the waveguide gasket extends.

According to an example, such a waveguide gasket may be manufactured by means of a second method for manufacturing a waveguide gasket, where the method comprises:

cutting a metal sheet in a rectangular shape; and forming electrically conducting members in the metal sheet attached to a first frame part and a second frame part of the metal sheet by using either etching or laser-cutting.

More examples are disclosed in the dependent claims.

BRIEF DESCRIPTION OF THE DRAWINGS

The present disclosure will now be described more in detail with reference to the appended drawings, where.

DETAILED DESCRIPTION

Figure 1:
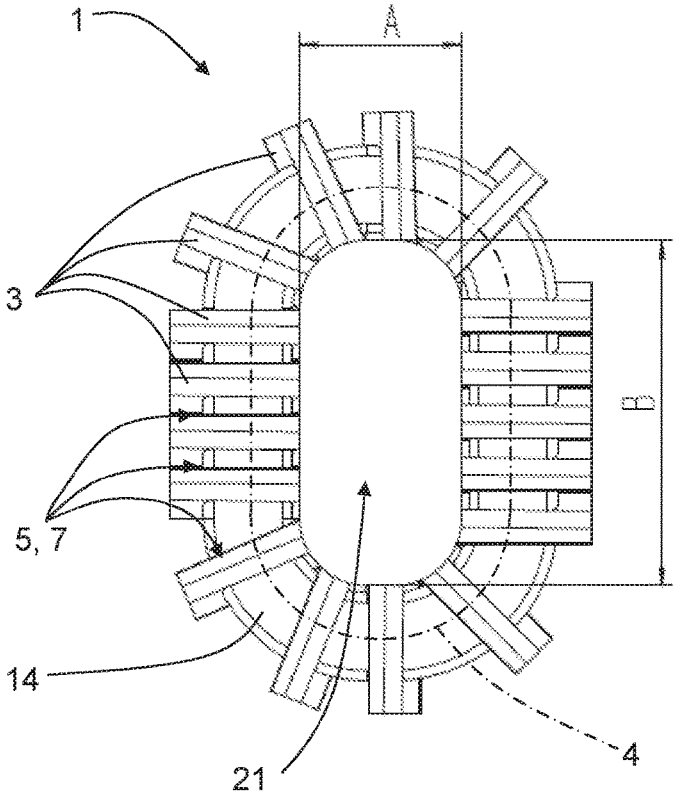
FIG. 1 shows a schematic top view of a waveguide gasket according to a first example.
Figure 2:
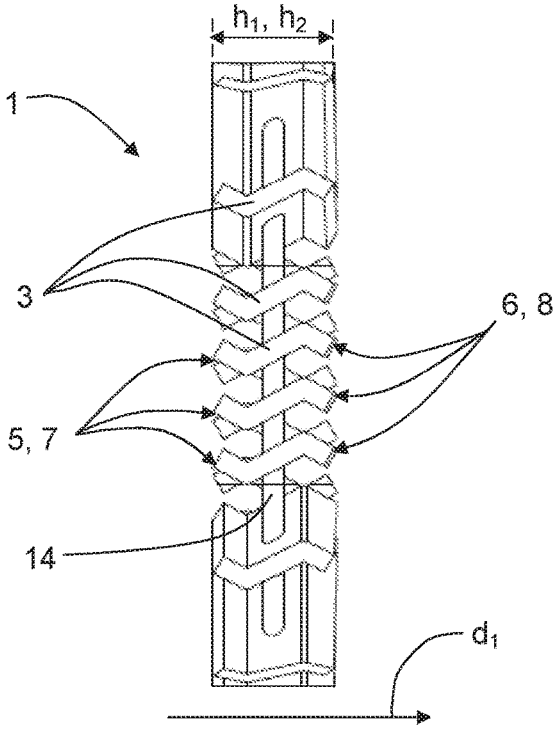
FIG. 2 shows a schematic side view of the waveguide gasket according to the first example.
Figure 3:
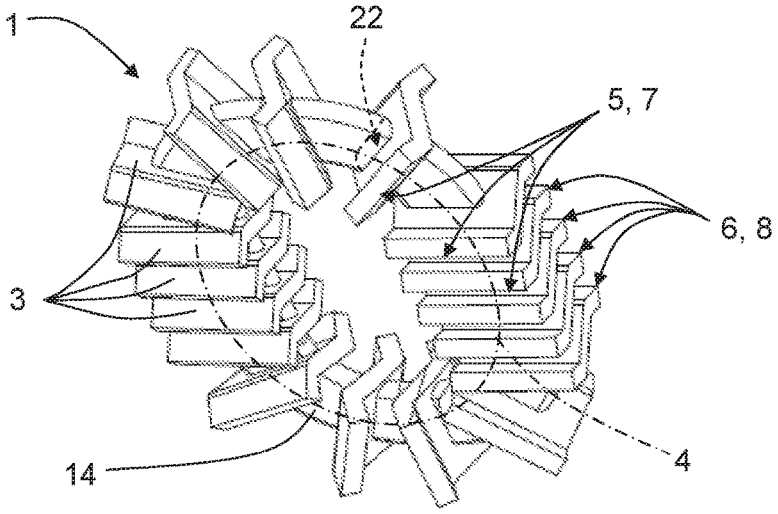
FIG. 3 shows a schematic bottom perspective view of the waveguide gasket according to the first example.
Figure 4:
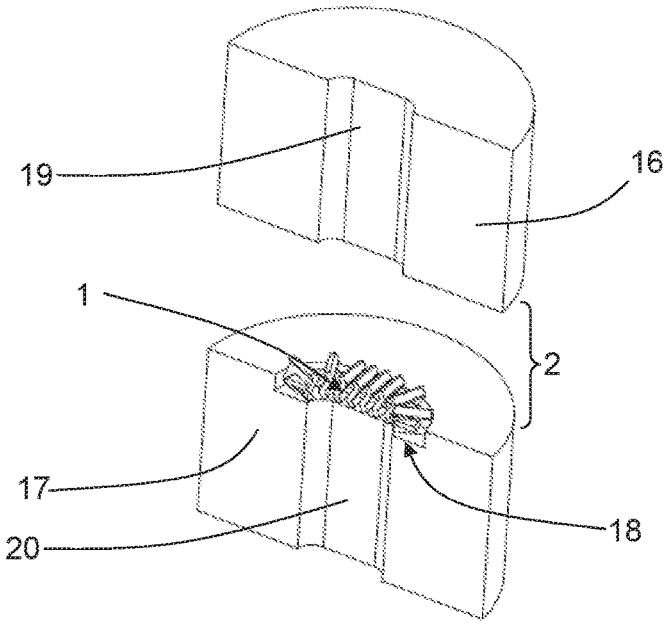
FIG. 4 shows a cut-open perspective side view of two waveguide sections at an interface with the waveguide gasket according to the first example.
Figure 5:
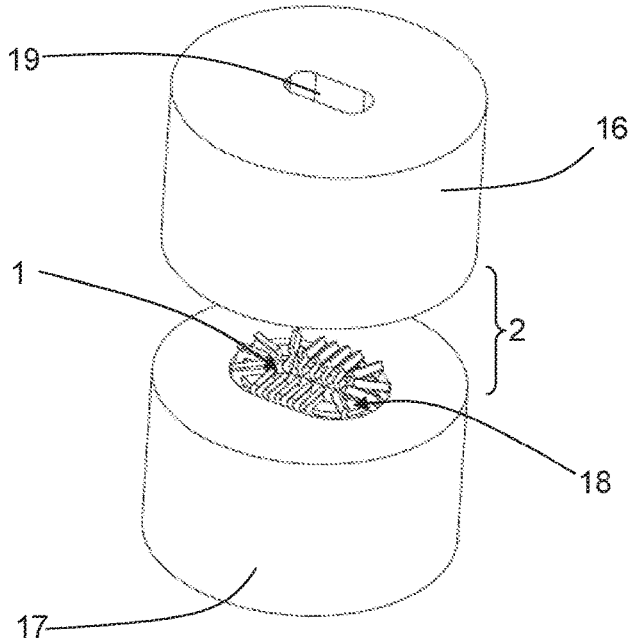
FIG. 5 shows a perspective side view of the waveguide sections.

FIG. 1, FIG. 2 and FIG. 3 shows a first example of a waveguide gasket 1 arranged for electrically sealing a waveguide interface 2 as shown in FIG. 4 and FIG. 5. FIG. 1 shows a top view of the waveguide gasket 1, FIG. 2 shows a side view of the waveguide gasket 1 and FIG. 3 shows a bottom perspective view of the waveguide gasket 1. FIG. 4 shows a cut-open perspective side view of two waveguide sections, and FIG. 5 shows a perspective side view of the waveguide sections.

As schematically indicated in FIG. 4 and FIG. 5, there is a first waveguide section 16 and a second waveguide section 17 that are intended to be attached to each other such that a first waveguide channel 19, comprised in the first waveguide section 16, and a second waveguide channel 20, comprised in the second waveguide section 16, are mechanically and electrically connected to each other. In this way a waveguide interface 2 is formed, and in order to provide an electrical and mechanical seal for the waveguide interface 2, a waveguide gasket 1 is positioned in a groove 18 in the second waveguide section 17. The waveguide sections 16, 17 are comprised in a waveguide arrangement.

Herein, an electrical seal is a seal that prevents an electromagnetic field contained within the waveguide arrangement to escape the waveguide arrangement at a transition between the waveguide sections 16, 17, at the waveguide interface 2. By means of the electrical seal, electrical insulation is conferred.

For this purpose, the waveguide gasket 1 comprises a first contact end 7 and second contact end 8 as shown in FIG. 1, FIG. 2, and FIG. 3, where the first contact end 7 is arranged to be in electrical contact with the first waveguide section 16 and the second contact end 8 is arranged to be in electrical contact with the second waveguide section 17.

The waveguide gasket 1 comprises a plurality of discrete electrically conducting members 3 (only a few indicated in the FIGS. 1-3 for reasons of clarity) that are positioned along a circumference 4 along which the waveguide gasket extends. The electrically conducting members 3 are attached to a common holding member 14 that runs along the circumference 4, where the electrically conducting members 3 each have an aperture 22 through which the common holding member 14 runs, the aperture 22 being indicated in FIG. 3. In this way, the electrically conducting members 3 are threaded on the common holding member 14 as pearls on a string, where the holding member 14 is made in any suitable material which, according to some aspects, is not electrically conducting.

The common holding member 14 is not necessary for the waveguide gasket to provide the intended function. Other alternative holding means providing a function similar to that provided by the holding member, i.e., to keep electrically conducting members 3 at appropriate relative positions in the gasket, are conceivable. For instance, the waveguide gasket is, according to some aspects, integrated in one of the waveguide sections.

Each electrically conducting member 3 has a first end 5 and a second end 6 (only a few indicated in the FIGS. 1-3 for reasons of clarity) that are compressibly separable by a variable first height $h_1$ along a first direction $d_1$. This means that the first height $h_1$ separates the first end 5 and the second end 6 in a variable manner, where the variation is obtained by a degree of compression that a electrically conducting member 3 is subject to. For an increased degree of compression, the separation between the first end 5 and the second end 6 decreases, and for a decreased degree of compression, the separation between the first end 5 and the second end 6 increases.

In this first example, the first ends 5 of the electrically conducting members 3 form the first contact end 7, and the second ends 6 of the electrically conducting members 3 form the second contact end 8.

Generally, each first end 5 faces the first contact end 7, and each second end 6 faces the second side contact end 8. It is noted that the first and second contact ends, after compression, is not necessarily parallel to each other, thus, the first contact end 7 and the second contact end 8 are separated by a variable second height $h_2$ along the first direction $d_1$. In this example, the first height $h_1$ is equal to the second height $h_2$ since the first ends 5 form the first contact end 7 and the second ends 6 form the second contact end 8.

According to the present disclosure, the electrically conducting members 3 are arranged to expand only along said circumference 4 when compressed. This means that a first gasket measure A and a second gasket measure B, indicated in FIG. 1 and defining width and height of a gasket opening 21 that is surrounded by the electrically conducting members 3, are unaffected by the compression of the waveguide gasket 1. An expansion of the waveguide gasket 1 in a direction towards the gasket opening 21 is avoided, which leads to that when mounted in a waveguide interface 2, an expansion towards the waveguide channels 19, 20 is avoided during compression of the electrically conducting members 3. Thus, a waveguide gasket is provided that does not affect the transmission properties of the waveguide arrangement when compressed. Electrical insulation is maintained while the waveguide gasket at the same time is able to handle relatively large gaps and angular misalignment between waveguide sections when assembling.

Figure 6A:
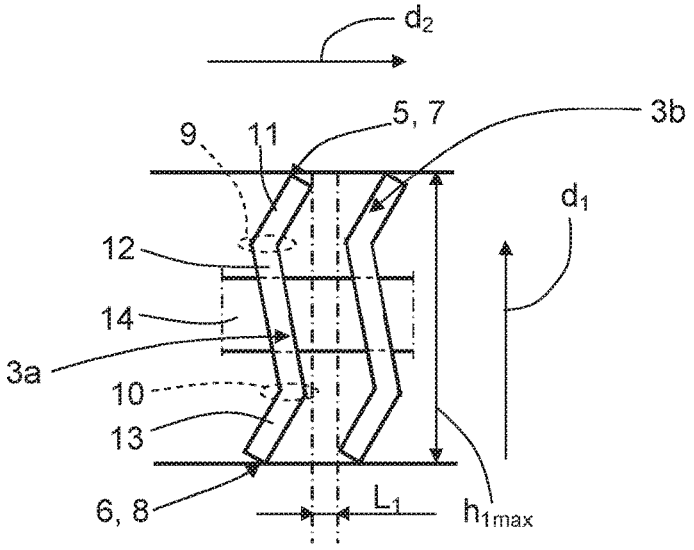
FIG. 6*a* shows a schematic side view of two electrically conducting members according to the first example in a first compression state.

With reference to FIG. 6*a*, showing a first electrically conducting member 3*a* and an adjacent second electrically conducting member 3*b* in a first compression state; here the electrically conducting members 3*a*, 3*b* are as extended as possible such that the variable first height $h_1$ is equal to a maximum first height $h_{1max}$; generally the variable first height $h_1$ is equal to or falls below the maximum first height $h_{1max}$.

Figure 6B:
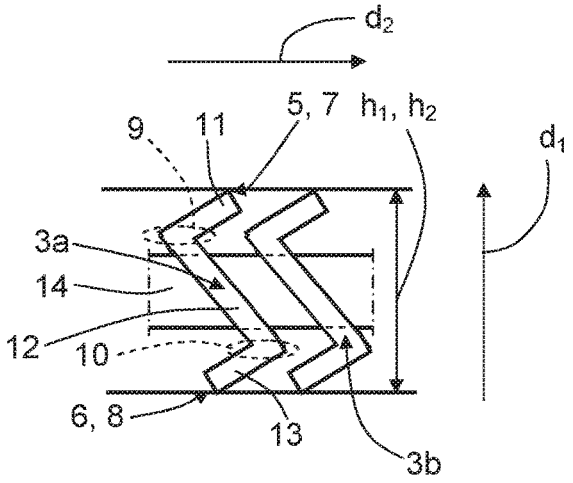
FIG. 6*b* shows a schematic side view of two electrically conducting members according to the first example in a second compression state.

This is illustrated in FIG. 6*b*, showing the electrically conducting members 3*a*, 3*b* in a second compression state where the electrically conducting members 3*a*, 3*b* are more compressed such that the variable first height $h_1$ falls below the maximum first height $h_{1max}$.

The electrically conducting members 3 are here formed such that partial overlaps occur in a direction along the circumference 4 during compression for adjacent electrically conducting members, since parts of adjacent electrically conducting members 3*a*, 3*b* come closer to each other when expanding along the circumference 4 during compression. This results in that the maximum first height $h_{1max}$ exceeds a first distance $L_1$ defining a length of a space between adjacent electrically conducting members along a second direction $d_2$ perpendicular to the first direction $d_1$ when the variable first height $h_1$ equals the maximum first height $h_{1max}$. This provides an advantage for the waveguide gasket 1 since the first distance $L_1$ may be kept sufficiently small for forming a virtual electrical wall, maintaining an electrical insulation, while the waveguide gasket 1 at the same time is able to adapt to relatively large distance differences between the waveguide sections 16, 17 at the interface 2 since the maximum first height $h_{1max}$ may be kept relatively large. The maximum first height $h_{1max}$ may be determined more or less independently of the first distance $L_1$. The virtual wall is here constituted by a virtual RF (Radio Frequency) ground.

As shown in FIG. 6*a* and FIG. 6*b*, as indicated for the first electrically conducting member 3*a*, each electrically conducting member is formed by discrete elements that each comprises a first inclination section 9 and a second inclination section 10. Each inclination section 9, 10 is arranged to move towards adjacent electrically conducting members 3*b* when the first height $h_1$ decreases.

The first inclination section 9 is connected to two opposing sections 11, 12; a first section and a second section. The second inclination section 10 is also connected to two opposing sections 12, 13; the second section 12 and a third section. The sections 11, 12, 13 are arranged to be folded towards each other when the first height $h_1$ decreases.

According to some aspects, the electrically conducting members 3 each comprise only one inclination section.

According to some aspects, the electrically conducting members 3 each comprise three or more inclination sections.

Figure 7:
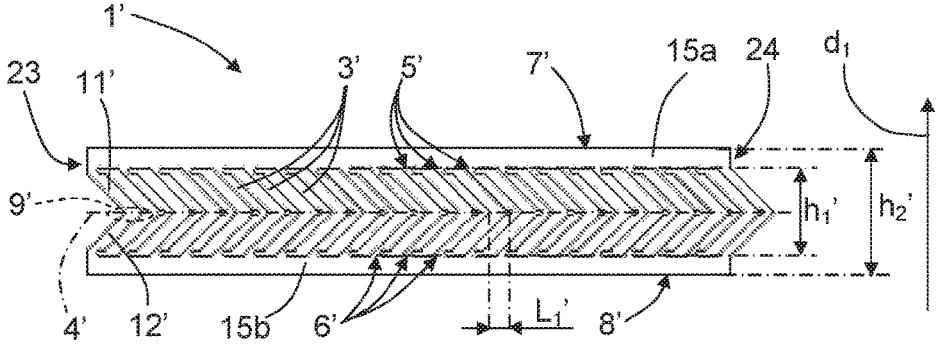
FIG. 7 shows a schematic top view of a metal sheet structure that is intended to form a waveguide gasket according to a second example when folded.
Figure 8:
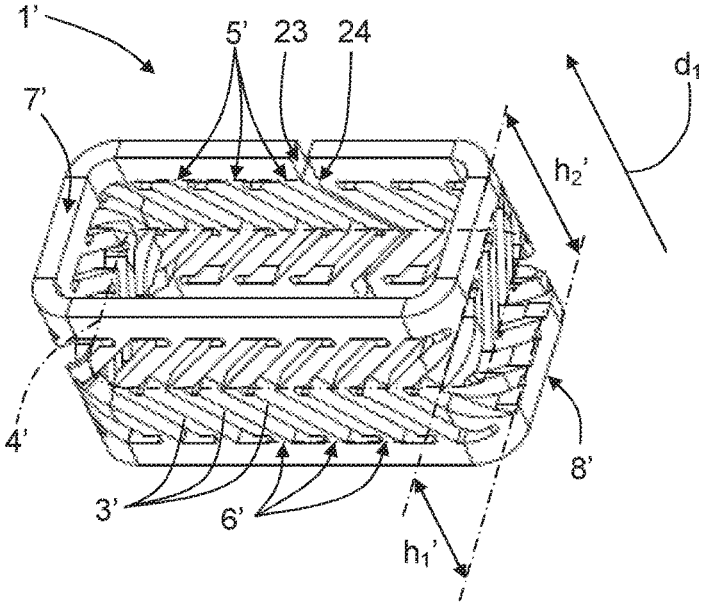
FIG. 8 shows a schematic top perspective view of the waveguide gasket according to the second example.

With reference to FIG. 7, showing a second example, there is a metal sheet structure that is intended to form a waveguide gasket 1' when re-shaped to form a cylinder-like shape as shown in FIG. 8, where two ends 23, 24 at least have been moved to either face each other or overlap, alternatively attached to each other. The metal sheet structure is made from a metal sheet where, according to some aspects, the structure is etched or laser-cut from a metal sheet. In the following, the metal sheet structure will be referred to as a waveguide gasket both before and after having been re-shaped to form a cylinder. According to some aspects, the metal sheet is thin in relation to a wall thickness of the waveguide sections 16, 17.

As shown in FIG. 8, the cylinder-like shape may be oval, or almost rectangular, the shape being adapted such that a desired shape of the gasket 1' is acquired.

The waveguide gasket 1' comprises a plurality of electrically conducting members 3' (only a few indicated in the FIGS. 7-8 for reasons of clarity) that are positioned to along a circumference 4' along which the waveguide gasket 1' extends. Each electrically conducting member 3' has a first end 5' and a second end 6' (only a few indicated in the FIGS. 7-8 for reasons of clarity) that are compressibly separable by a variable first height $h_1$ along a first direction $d_1$. The electrically conducting members 3' are attached to a first frame part 15*a* and a second frame part 15*b* such that the first ends 5' are connected to the first frame part 15*a* and the second ends 6' are connected to the second frame part 15*b*. The first contact end 7' is arranged to be in electrical contact with the first waveguide section 16 and the second contact end 8' is arranged to be in electrical contact with the second waveguide section 17 as in the first example.

Due to the width of the first frame part 15*a* and the second frame part 15*b*, there is a distance between the first ends 5' and the first contact end 7', and also between the second ends 6' and the second contact end 8', such that each first end 5' faces the first contact end 7', and each second end 6' faces the second side contact end 8'. The first contact end 7' and the second contact end 8 are' separated by a variable second height $h_2'$ along the first direction $d_1$, where the second height $h_2'$ exceeds the first height $h_1'$. As in the first example, the electrically conducting members 3' are arranged to expand only along the circumference 4' when compressed.

The electrically conducting members 3' each comprise one inclination section 9' that is arranged to move towards at least one other adjacent electrically conducting member 3' when the first height $h_1'$ decreases. Each inclination section 9' is connected to two opposing sections 11', 12', where the sections 11', 12' are arranged to be folded towards each other when the first height $h_1'$ decreases.

For the first example and the second example, the inclination sections 9, 10; 9' are formed as joints, but according to some aspects, the inclination sections 9, 10; 9' may be formed by arcuate sections such as circle segments or similar.

According to some aspects, the electrically conducting members 3' each comprise more than one inclination section 9'.

Figure 9:
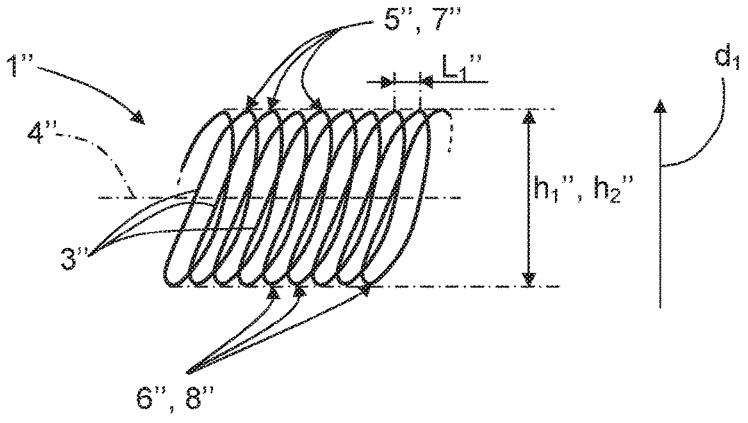
FIG. 9 shows a schematic side view of a part of a waveguide gasket according to a third example.
Figure 10:
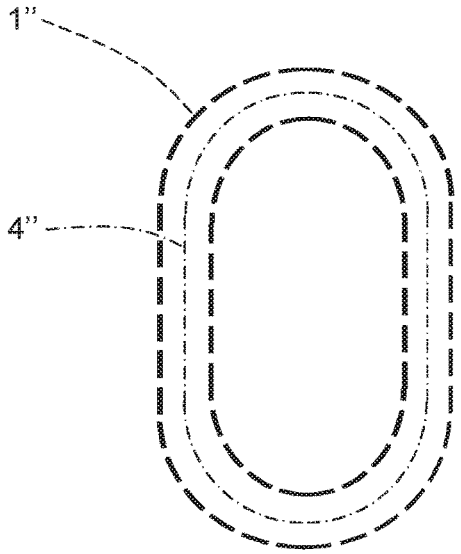
FIG. 10 shows a schematic top view of the waveguide gasket according to the third example.

With reference to FIG. 9 and FIG. 10, showing a third example, there is a waveguide gasket 3" that is constituted by a metal helix spring with a plurality of turns. Each turn of the helix spring constitutes an electrically conducting member 3" such that the waveguide gasket 1" comprises a plurality of electrically conducting members 3" (only a few indicated in the FIGS. 9-10 for reasons of clarity) that are positioned along a circumference 4" along which the waveguide gasket 1" extends.

FIG. 9 shows a section of the waveguide gasket 3" with a plurality of turns, and FIG. 10 schematically indicates the waveguide gasket 3" without showing the individual turns of the helix spring. Each electrically conducting member 3" has a first end 5" and a second end 6" (only a few indicated in FIG. 9 for reasons of clarity) that are compressibly separable by a variable first height $h_1''$ along a first direction $d_1$. In this first example, the first ends 5" of the electrically conducting members 3" form a first contact end 7", and the second ends 6" of the electrically conducting members 3" form the second contact end 8". As in the previous examples, the electrically conducting members 3" are arranged to expand only along said circumference 4" when compressed.

In the same way as in the first example, for the second example and the third example the electrically conducting members 3', 3" are formed such that partial overlaps occur during compression for adjacent electrically conducting members 3', 3". This results in that the maximum first height exceeds a first distance $L_1'$, $L_1''$ defining a length of a space between adjacent electrically conducting members along a second direction $d_2$ perpendicular to the first direction $d_1$ when the variable first height $h_1'$, $h_1''$ equals the maximum first height. In FIG. 7 and FIG. 9, it is assumed that the variable first height $h_1'$, $h_1''$ equals the maximum first height.

Figure 11:
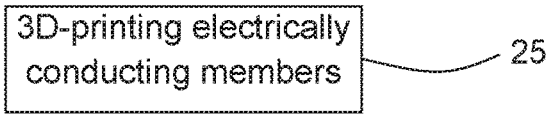
FIG. 11 shows a flowchart for a first manufacturing method.

With reference to FIG. 11, the present disclosure also relates to a first method for manufacturing a waveguide gasket 1, where the method comprises:

25: Using a 3D-printer for printing a plurality of electrically conducting members 3 that are positioned along a circumference 4 along which the waveguide gasket 1 extends.

Suitably, a common holding member 14 along which the electrically conducting members 3 are positioned is printed together with the electrically conducting members 3. The common holding member 14 and the electrically conducting members 3 then form one integral part.

Figure 12:
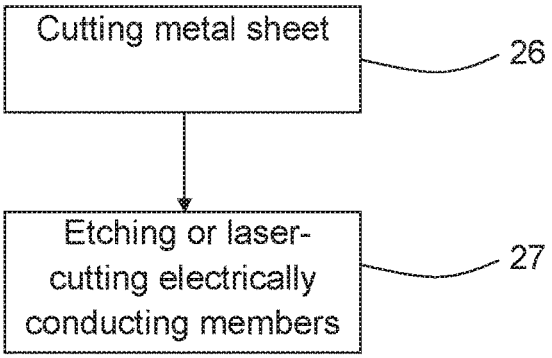
FIG. 12 shows a flowchart for a second manufacturing method.

With reference to FIG. 12, the present disclosure also relates to a second method for manufacturing a waveguide gasket 1', where the method comprises:

26: Cutting a metal sheet in a rectangular shape.

27: Forming electrically conducting members 3' in the metal sheet attached to a first frame part 15*a* and a second frame part 15*b* of the metal sheet by using either etching or laser-cutting.

The present disclosure is not limited to the above, but may vary freely within the scope of the appended claims. For example, there may be plurality of discrete electrically conducting members 3 as in the first example but without the common holding member 14, where the electrically conducting members 3 instead are placed separately in suitable slots in the groove 18. Such a placement may be made by a pick-and-place machine.

According to some aspects, the electrically conducting members 3 and the common holding member 14 are made from one and the same piece of material.

According to some aspects, the waveguide gasket is made as an integral part of a waveguide section.

According to some aspects, the waveguide gasket is made by means of a 3D-printer. For the first example, this means that the electrically conducting members 3 and the common holding member 14 are formed as one piece, no special apertures being needed in the electrically conducting members 3.

According to some aspects, the common holding member 14 is an electrically conducting part.

According to some aspects, the electrically conducting parts are made in any suitable electrically conducting material such as metal or plastic that either is covered with an electrically conductive coating or comprising an electrically conducting compound.

Each inclination section is connected to at least two opposing sections; according to some aspects, the electrically conducting members may be X-shaped such that each inclination section is connected to four opposing sections.

Generally, the present disclosure relates to a waveguide gasket 1 arranged for electrically sealing a waveguide interface 2 between a first contact end 7 and second contact end 8 of the waveguide gasket, wherein the waveguide gasket 1 comprises a plurality of electrically conducting members 3 that are positioned along a circumference 4 along which the waveguide gasket 1 extends, each electrically conducting member 3 having a first end 5 and a second end 6 compressibly separable by a variable first height $h_1$ along a first direction $d_1$, the variable first height $h_1$ being equal to, or falling below, a maximum first height $h_{1max}$, where each first end 5 faces the first contact end 7 and each second end 6 faces the second side contact end 8, where each first contact end 7 and each second contact end 8 are separated by a variable second height $h_2$ along the first direction $d_1$, where at least one electrically conducting member 3 is arranged to expand only along said circumference 4 when compressed, such that an expansion of the waveguide gasket 1 in a direction towards a gasket opening 21 that is defined and surrounded by the electrically conducting members 3 is avoided.

According to an example, at least one electrically conducting member 3, 3', 3" is arranged to expand during compression only towards at least one other adjacent electrically conducting member 3, 3', 3".

According to an example, at least one electrically conducting member 3, 3', 3" is formed such that a partial overlap with at least one other adjacent electrically conducting member 3, 3', 3" is enabled during compression.

According to an example, the first height $h_1$, $h_1''$ is equal to the second height $h_2$, $h_2''$.

According to an example, wherein the electrically conducting members 3" are connected to each other, forming a waveguide gasket in the form of a helix spring 1".

According to an example, the electrically conducting members 3 are formed by discrete elements that each comprise at least one inclination section 9, 10, each inclination section 9, 10 being arranged to move towards at least one other adjacent electrically conducting member 3 when the first height $h_1$ decreases.

According to an example, each inclination section 9, 10 is connected to at least two opposing sections 11, 12, 13, where the sections 11, 12, 13 are arranged to be folded towards each other when the first height $h_1$ decreases.

According to an example, the electrically conducting members 3 are attached to a common holding member 14.

According to an example, the electrically conducting members 3' are attached to a first frame part 15*a* and a second frame part 15*b*, where the first frame part 15*a* comprises the first side contact end 7' and the second frame part 15*b* comprises the second side contact end 8'.

According to an example, the electrically conducting members 3' each comprise at least one inclination section 9', each inclination section 9' being arranged to move towards at least one other adjacent electrically conducting member 3' when the first height $h_1'$ decreases.

According to an example, each inclination section 9' is connected to at least two opposing sections 11', 12', where the sections 11', 12' are arranged to be folded towards each other when the first height $h_1'$ decreases.

According to an example, the maximum first height $h_{1max}$ exceeds a first distance $L_1$ defining a length of a space between adjacent electrically conducting members along a second direction $d_2$ perpendicular to the first direction $d_1$ when the variable first height $h_1$ equals the maximum first height $h_{1max}$.

Generally, the present disclosure also relates to a waveguide section, comprising a waveguide gasket according to any of claims 1-10 arranged along a circumference of an opening of the waveguide.

Generally, the present disclosure also relates to a method for manufacturing a waveguide gasket 1, where the method comprises:

25: using a 3D-printer for printing a plurality of electrically conducting members 3 that are positioned along a circumference 4 along which the waveguide gasket 1 extends.

Generally, the present disclosure also relates to a method for manufacturing a waveguide gasket 1', where the method comprises:

26: cutting a metal sheet in a rectangular shape; and

27: forming electrically conducting members 3' in the metal sheet attached to a first frame part 15*a* and a second frame part 15*b* of the metal sheet by either using etching or laser-cutting.

The invention claimed is:

1. A waveguide gasket configured to electrically seal a waveguide interface between a first contact end and second contact end of the waveguide gasket, wherein the waveguide gasket comprises a plurality of individual electrically conducting members that are positioned along a circumference along which the waveguide gasket extends, each electrically conducting member having a first end and a second end compressibly separable by a variable first height along a first direction, the variable first height being equal to, or falling below, a maximum first height, wherein each first end faces the first contact end and each second end faces the second contact end, wherein the electrically conducting members are strung on a common holding member or interconnected between first and second rigid frames respectively forming the first and second contact ends, wherein each first contact end and each second contact end are separated by a variable second height along the first direction, and wherein at least one of the electrically conducting members is arranged to expand only along said circumference when compressed, such that an expansion of the waveguide gasket in a direction towards a gasket opening that is defined and surrounded by the electrically conducting members is avoided.

2. The waveguide gasket of claim 1, wherein at least one electrically conducting member is arranged to expand during compression only towards at least one other adjacent electrically conducting member.

3. The waveguide gasket of claim 1, wherein at least one electrically conducting member is formed such that compression of the electrically conducting member causes it to partially overlap with at least one other adjacent electrically conducting member.

4. The waveguide gasket of claim 1, wherein the maximum first height exceeds a first distance defining a length of a space between adjacent electrically conducting members along a second direction perpendicular to the first direction when the variable first height equals the maximum first height.

5. The waveguide gasket of claim 1, wherein the first height is equal to the second height.

6. The waveguide gasket of claim 5, wherein the electrically conducting members are formed by discrete elements that each comprise at least one inclination section, each inclination section being arranged to move towards at least one other adjacent electrically conducting member when the first height decreases.

7. The waveguide gasket of claim 6, wherein each inclination section is connected to at least two opposing sections, wherein the opposing sections are arranged to be folded towards each other when the first height decreases.

8. The waveguide gasket of claim 1, wherein the electrically conducting members each comprise at least one inclination section, each inclination section being arranged to move towards at least one other adjacent electrically conducting member when the first height decreases.

9. The waveguide gasket of claim 8, wherein each inclination section is connected to at least two opposing sections, wherein the opposing sections are arranged to be folded towards each other when the first height decreases.

10. A waveguide section having a waveguide opening and comprising, arranged along a circumference of the waveguide opening, a waveguide gasket configured to electrically seal a waveguide interface between a first contact end and second contact end of the waveguide gasket, wherein the waveguide gasket comprises a plurality of individual electrically conducting members that are positioned along said circumference, each electrically conducting member having a first end and a second end compressibly separable by a variable first height along a first direction, the variable first height being equal to, or falling below, a maximum first height, wherein each first end faces the first contact end and each second end faces the second contact end, wherein the electrically conducting members are strung on a common holding member or interconnected between first and second rigid frames respectively forming the first and second contact ends, wherein each first contact end and each second contact end are separated by a variable second height along the first direction, and wherein at least one electrically conducting member is arranged to expand only along said circumference when compressed, such that an expansion of the waveguide gasket in a direction towards a gasket opening that is defined and surrounded by the electrically conducting members is avoided.

* * * * *